US005224825A

United States Patent [19]

Strang et al.

[11] Patent Number: 5,224,825

[45] Date of Patent: Jul. 6, 1993

[54] LOCATOR PIN RETENTION DEVICE FOR FLOATING JOINT

[75] Inventors: Steven A. Strang, Loveland; Bruce A. Borelli, Mason; George G. Cunningham, Jr., Fairfield, all of Ohio

[73] Assignee: General Electric Company, Cincinnati, Ohio

[21] Appl. No.: 813,546

[22] Filed: Dec. 26, 1991

[51] Int. Cl.[5] ..... F01D 1/02

[52] U.S. Cl. ..... 415/209.3; 415/136; 415/139; 415/135; 415/189

[58] Field of Search ..... 415/134, 135, 136, 137, 415/139, 189, 209.3, 191

[56] References Cited

U.S. PATENT DOCUMENTS

| | | | |
|---|---|---|---|
| 2,427,244 | 9/1947 | Warner | 415/136 |
| 2,447,942 | 8/1948 | Imbert et al. | 253/78 |
| 2,575,889 | 11/1951 | Oulianoff | 60/39.65 |
| 2,615,300 | 10/1952 | Lombard | 60/39.32 |
| 2,919,888 | 1/1960 | Simmons | 415/136 |
| 3,722,215 | 3/1973 | Zhdanov et al. | 60/39.32 |
| 3,758,229 | 9/1973 | Price et al. | 415/189 |
| 4,597,258 | 7/1986 | Harris | 60/39.31 |
| 5,131,811 | 7/1992 | Johnson | 415/134 |

FOREIGN PATENT DOCUMENTS

| | | | |
|---|---|---|---|
| 2532537 | 1/1977 | Fed. Rep. of Germany | 415/189 |

*Primary Examiner*—Edward K. Look
*Assistant Examiner*—Todd Mattingly
*Attorney, Agent, or Firm*—David L. Narciso; Jerome C. Squillaro

[57] ABSTRACT

A locator pin retention device comprises a pin with threaded and smooth portions cooperating with a bushing having spaced apart threaded and smooth portions to allow alignment of inner and outer gas turbine engine members exposed to different thermal environments, allowing thermal growth of the inner member in a radially outward direction toward the outer member and reacting axial and circumferential loads to prevent transverse movement to the outer structural member. The device reduces machining of the structural members because machined retention means are inexpensive and replaceable parts.

9 Claims, 3 Drawing Sheets

LOCATOR PIN RETENTION DEVICE FOR FLOATING JOINT

The U.S. Government has rights in this patent pursuant to Contract No. F33657-83C-0281 awarded by the Department of the Air Force.

FIELD OF THE INVENTION

This invention relates generally to gas turbine engines and more particularly to apparatus for fixing the location of an inner ring type engine member exposed to a high temperature environment relative to an outer engine support member exposed to a lower temperature environment, allowing for radially outward thermal growth of the ring member in the direction of the support member while restraining movement in transverse directions.

BACKGROUND OF THE INVENTION

Gas turbine engines typically include inner flowpath surface elements that define a core flowpath for working gases. These surface elements are subject to high temperatures and are supported by a relatively cool engine structure. The different thermal environments require the inner flowpath surface elements to be thermally independent of the engine structure. Conventionally, the core flowpath defining surface elements are ring type hardware, such as nozzle vanes and turbine shrouds, that expand radially outward in response to temperature increases. Locator pins are conventionally used with the engine structure to retain these ring type flowpath surface elements in position circumferentially and axially relative to the engine structure while allowing for such radial thermal growth.

In addition to allowing for thermal growth of ring type engine members in the radial direction, a locator pin retention system should react axial and circumferential loads from the ring members in shear to minimize pin bending stress. Additionally, the pin should be removable so that the ring can be disassembled from the adjacent structure for repair and maintainability. The pin should also be locked in place during engine operation in order to prevent the pin from moving radially outward and thereby disconnecting from the ring.

FIG. 1 shows an existing pin retention system currently in use. This pin retention system utilizes a clip 10 that prevents radial outward movement of a pin 12. The pin 12 is seated in a tight tolerance interference fit hole 14 in an engine structure 16 to provide, with respect to the pin axis 13, shear loading in response to, with respect to engine centerline 17, circumferential and axial loading of a nozzle support segmented ring member 18. The clip 10 must be bent over manually in order to retain the pin 12. A disadvantage of this system is that the clip 10 must be made from a material that can be easily deformed for both installation and removal of the pin 12. The clip 10 therefore cannot resist a high degree of radial load that the pin 12 may exert, such as when the pin 12 binds in the inner ring member 18 and carries a load resulting from thermal growth of the inner member 18 radially outward.

SUMMARY OF THE INVENTION

The locator pin retention device of the present invention provides a replaceable locating pin apparatus that allows for thermal growth in the direction of the pin axis while reacting loads transverse to that axis in shear to the support member. Loads are reacted through inexpensive, easily replaceable hardware, to engine structural members. Less machining of engine structural members is required, as any need for tapped threads in the engine structure to accomodate the locating pin apparatus is eliminated.

In a particular embodiment the locator pin retention apparatus locates an inner ring member in relation to an outer engine structural member, axially and circumferentially, with respect to the engine centerline, aligning the inner ring relative to the outer member. The outer structural member has a bore extending radially therethrough generally aligned with a smaller diameter bore on the inner ring extending radially inward from the outer surface of the inner ring. The outer bore can be outfitted with a bushing having a lip engaging the inner surface of the outer member and a squared edge of the lip engaging a radial surface of the outer member, preventing rotation of the bushing. The bushing has an outer cylindrical surface sized to interference fit within the outer member bore, and is preferrably installed from the inner side of the outer member. The interior of the bushing has a threaded portion separated by a groove, having a diameter larger than the thread major radius, from a smooth cylindrical surface of a diameter smaller than the thread minor radius. The smooth inner surface extends to the bushing end and terminates in a stop lip. A pin with a shank extending from a hex head is installed from the radially outer side of the outer member. A portion of the shank adjacent the head is threaded for engaging the bushing threads. The opposite end of the shank includes a smooth, dowel portion, of a diameter smaller than the threaded portion, that upon threaded engagement of the bushing and pin engages the bushing smooth inner surface in close tolerance fit and simultaneously engages the inner member bore in an open clearance fit, fixing the location of the bore and thus the inner ring relative to the outer support member. A tab washer engaging the hex head and a radial surface of the outer member can be used to prevent rotation of the installed pin.

During engine operation bypass air cools the outer structural member while the inner ring member is subjected to high temperatures from hot core gases. The inner ring member thermally responds by expanding radially outward with the inner bore surface sliding along the pin dowel surface, while the inner bore surface is restrained from axial and circumferential displacement by the pin dowel. Axial and circumferential loads are reacted by the dowel in shear through the bushing smooth inner surface to the outer structure and the groove between the smooth and threaded inner surfaces prevents bending loads from reaching the threaded portion. Any binding of the bore and pin dowel will cause loads axial to the pin to be reacted by the threads, through the bushing lip, and into the outer structure. Thus the subject bushing and pin apparatus maintains axial and circumferential part alingment by reacting much greater force than the clip and pin apparatus presently in use, and also prevents the pin from backing out of the bore.

Disassembly of the retention system is accomplished by removing the tab washer and then unscrewing the pin. The bushing can be removed from the structure by forcing the bushing inward with a punch and hammer.

A major advantage of this retention system is that the only machining required of the outer structure and inner ring are drilled, chamferred holes, and in a preferred embodiment, four milled flat surfaces at each pin location. The threaded bushing avoids expensive rework by applying threads to a minor, inexpensive piece of hardware, thereby eliminating any need to tap threads into the engine structure to accommodate such locator pins.

These and other features and advantages of the present invention will become apparent to those skilled in the art from the following detailed description of the preferred embodiments when taken in conjunction with the accompanying drawings.

BRIEF DESCRIPTION OF THE DRAWINGS

In the course of the following detailed description reference will be made to the accompanying drawings, in which.

DETAILED DESCRIPTION OF THE INVENTION

Figure 1:
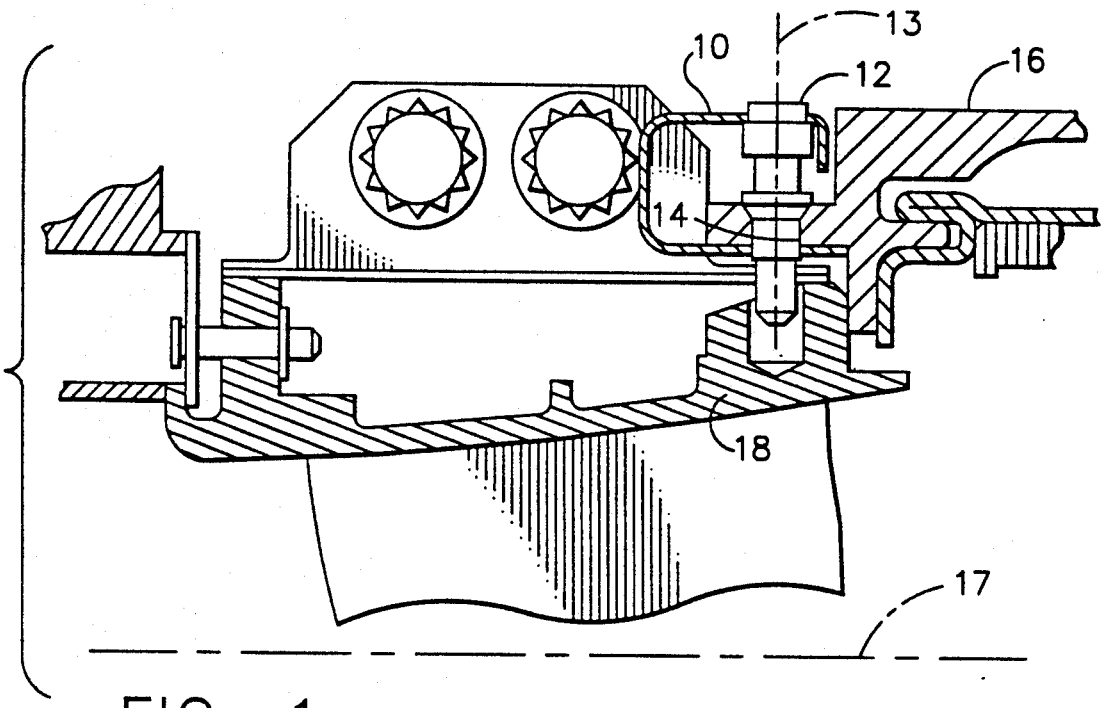
FIG. 1 (PRIOR ART)
FIG. 1 is an illustration of a side elevational view in partial cross section of an existing locator pin retention device assembly.

Like reference numerals have been used to designate like or corresponding parts throughout the several views.

Figure 2:
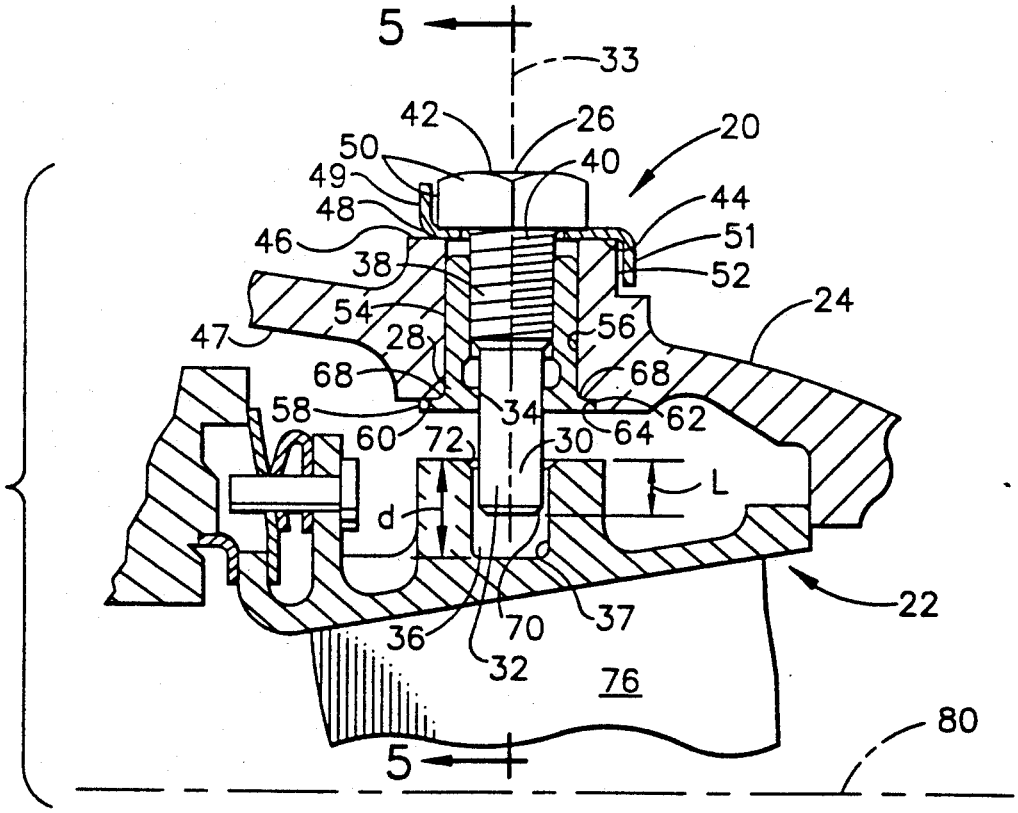
FIG. 2 is an illustration of a side elevational view in partial cross section of a locator pin retention device depicting the principles of this invention in a preferred embodiment, including a threaded bushing.

Referring now to FIG. 2, a partial cross section of a locator pin retention device 20 comprising a pin member 26 and a bushing member 28 is shown locating an inner ring member 22 supporting a vane 76 relative to a radially outer gas turbine engine structure 24.

Pin member 26 includes a head 42 and a shaft 32 with an axis 33. The head can have hex flats 50 for facilitating installation and removal, and the shaft 32 includes a first portion 40 adapted, such as by threads, for restrainedly coupling to the bushing 28, and a smooth cylindrical dowel-like second portion 30 with a smaller diameter than the first portion 40. A chamfer 70 can be located on the nose of the pin member shaft 32.

Figure 3:
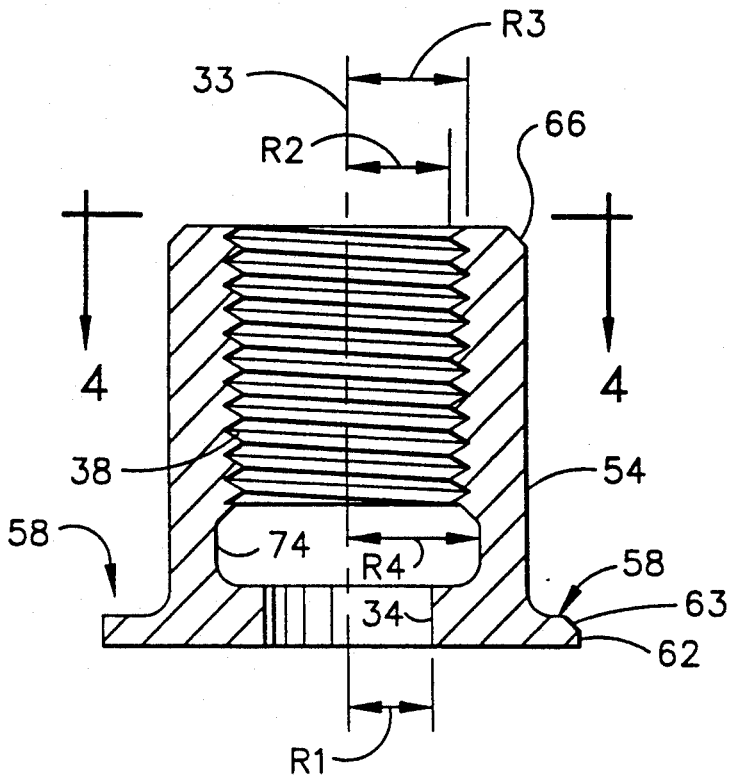
FIG. 3 is an illustration of an enlarged cross-sectional view of the threaded bushing of FIG. 2.
Figure 4:
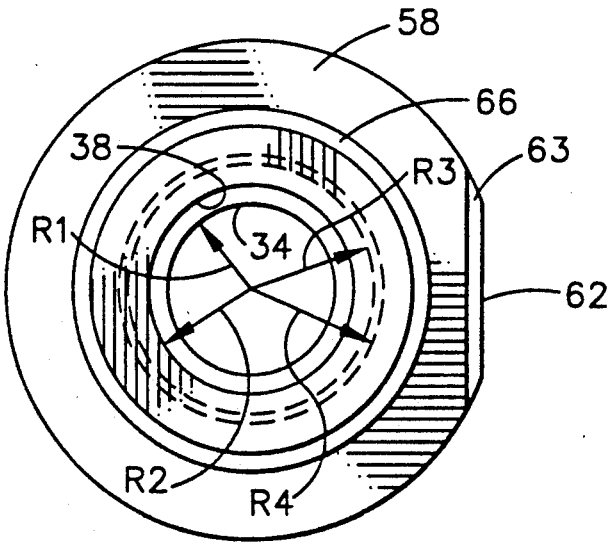
FIG. 4 is an illustration of a plan view of the bushing along lines 4—4 of FIG. 3.

Bushing member 28, also shown in an enlarged cross-sectional view in FIG. 3 and in plan view in FIG. 4, has a smooth outer cylindrical surface 54 with a diameter large enough to interference fit a bore 56 through the support structure 24. The bushing also includes a lip 58 for engaging a flat recessed or chamferred inner surface 60 of the outer structure 24 to prevent over-insertion of bushing 28 into bore 56. Lip 58 can have a squared off edge or outer flat 62 for fixedly and lockingly engaging, with respect to an engine centerline 80, a radially projecting surface 64 on the radially inner side of support structure 24. Chamfers 66 and 63 can be located on the nose of bushing 28 and flat 62, respectively, to facilitate installation of bushing 28. FIG. 3 shows the interior of bushing member 28 having a smooth cylindrical interior portion 34 with a radius R1 and a threaded portion 38 having a minor thread radius R2 and a major thread radius R3. R1 is smaller than R2. The threaded portion 38 is separated from the smooth cylindrical interior portion 34 by a stress relief groove 74 of a fourth radius R4 that is larger than the major thread radius R3. This groove 74 separates the smooth and threaded interior portions 34 and 38, respectively, and enables the cutting of the bushing threads without affecting the bore diameter of the smooth portion.

FIG. 4 shows the bushing 28 in plan view and illustrates the anti-rotation flat 62.

Figure 5:
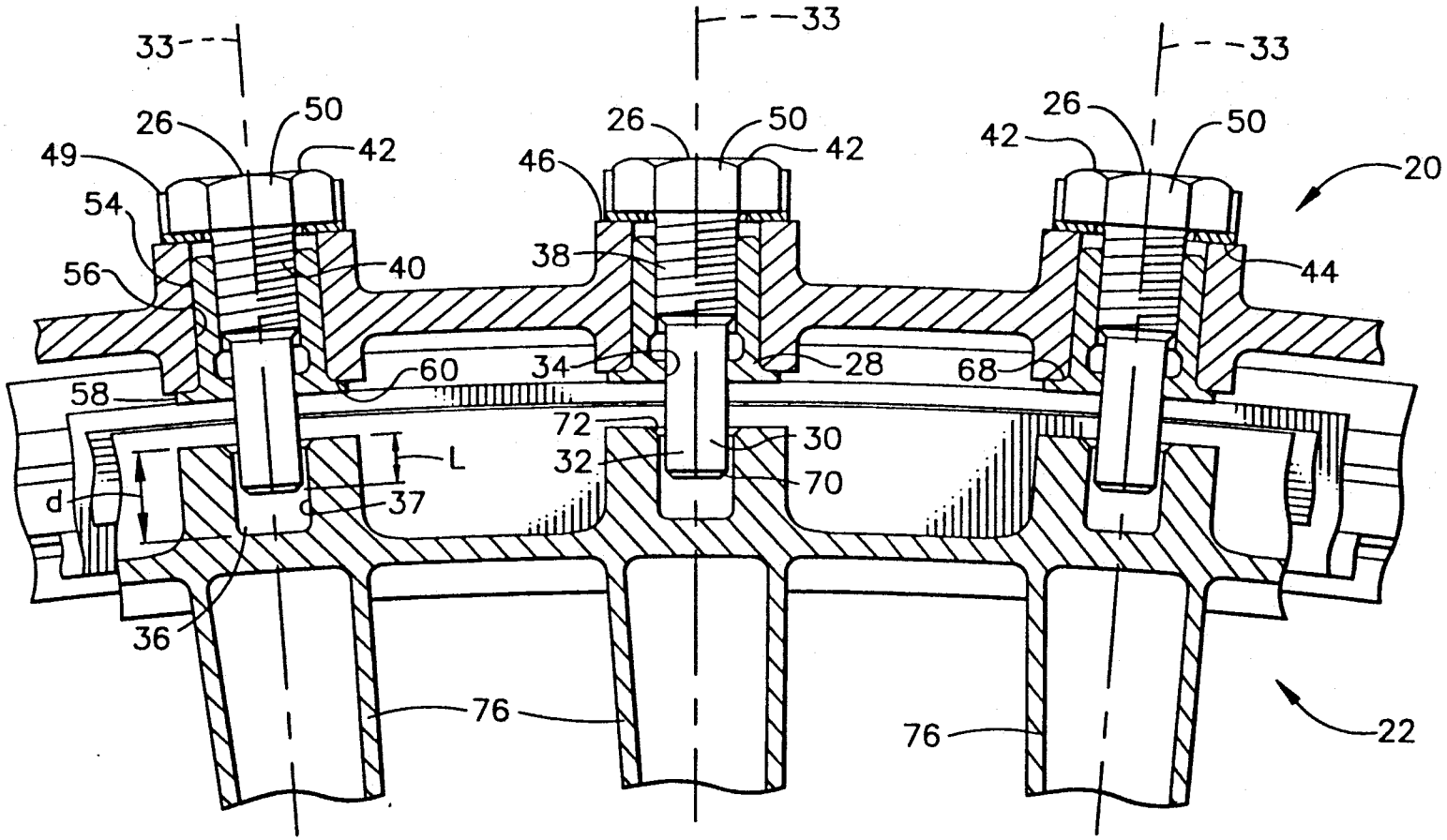
FIG. 5 is an illustration of an aft looking forward view in partial cross section of the assembly of inner and outer structural members along lines 5—5 of FIG. 2.

FIG. 5 shows, in partial cross section, inner ring member 22 retained in a substantially fixed axial and circumferential relationship to the radially outer gas turbine engine member 24 by a plurality of locator pin retention devices 20.

Referring again to FIG. 2, and with reference to engine centerline 80, a portion of a radially outer structural member 24 and an inner ring member 22 are illustrated. Structural member 24 has an outer surface 46 that can include a flat upper or pin seat surface 44 for restraining overinsertion of pin 26 and a radially extending cutout side surface 52 for engaging a tab 51 of tab washer 48. Structural member 24 has an inner surface 47 that can include a flat inner or bushing seat surface 60 for engaging bushing lip 58 and a radially extending stop surface 64 for engaging bushing lip flat 63. The bore 56 extends radially through outer structural member 24 and can be sized to provide an interference fit between the bushing outer cylindrical surface 54 and the bore 56. A chamfer 68 can be located on the inner surface 47 about the bore 56 to facilitate bushing 28 installation.

Inner ring member 22 includes a bore 36 to be, with respect to engine centerline 80, radially aligned with the bore 56 along pin shaft axis 33. The bore 36 preferrably has a cylindrical surface 37 and can include a chamfer 72 for guiding shaft 32 into bore 36 during installation. The bore 36 preferrably has a depth D greater than the length L of the pin dowel 30 to be inserted therein.

Assembly of the locator pin retention device 20 can be appreciated with reference to FIGS. 2–4. The device can be assembled by inserting the bushing 28 into the outer member bore 56 with bushing chamfer 66 and outer member chamfer 68 facilitating insertion. The bushing 28 can be forced into bore 56 in an interference fit between bushing outer surface 54 and the bore 56. This interference fit will hold bushing 28 in axial position within the bore 56 during assembly with the pin 26. Bushing 28 can be rotated until flat 62 is aligned with outer member surface 64, with the bushing lip chamfer 63 facilitating complete installation and engagement of the bushing flat 62 with the stop surface 64 to prevent rotation of bushing 28 during threaded installation of pin 26.

Pin 26 can be inserted from and through the outer surface 46 of the radially outer structure 24, with a tab washer 48 in place around the shaft. The smooth cylindrical portion 30, by virtue of its smaller diameter, passes through the bushing threaded portion 38 and mates with the bushing smooth portion 34 in close tolerance fit until the threaded portion 40 engages the bushing threaded portion 38. Pin chamfer 70 engages inner bore 36 at chamfer 72, facilitating insertion of pin 26 into bore 36, thus locating the inner bore 36 in relation to outer bore 56, aligning the inner and outer members in the plane transverse to the axis 33 of the pin shaft 32. The pin 26 can be rotated and threaded into the bushing 28 until an acceptable thread torque is reached while the bushing flat 62 engages and seats against the radial stop surface 64 of the support 24 and prevents rotation of bushing 28. Tabs 49 and 51 of tab washer 48 can be bent to engage a hex flat 50 on head 42 and the cutout radial surface 52 on outer member 24 respectively to prevent the pin 26 from rotating and backing out of the bore 56.

During engine operation, ring member 22 is exposed to hot core gases while outer structure 24 is exposed to relatively cooler gases. The ring member 22 will therefore seek to expand to a greater degree than the outer structure 24. During engine operation the core gas flow will also exert, with respect to the engine axis 80, axial and circumferential forces on inner ring member 22 and the attached vane 76 that must be reacted to prevent axial and circumferential misalignment of the inner ring member 22 and outer structure 24. Axial and circumferential forces place the surface 37 of the inner bore 36 into contact with smooth portion 30 of the pin 26. These forces are transmitted through the pin 26 to the bushing smooth portion 34 and into the outer structure 24 with groove 74 preventing bending stresses from concentrating in threaded portions 38 and 40. The floating joint permits radial expansion of the inner ring member 22 by a sliding fit between the pin smooth portion 30 and the bore 36. Radial forces, if any, that can result from binding of the inner bore surface 37 and the pin smooth portion 30 and caused by axial and circumferential loads in combination with radial expansive loads are reacted through the threaded portions 38 and 40 of the pin 26 and bushing 28 respectively, with bushing lip 58 and the locked threaded engagement between the pin 26 and bushing 28 preventing outward movement of the pin 26.

Dissassembly for service and replacement is accomplished by bending or breaking at least one of the bent tabs on tab washer 48 to allow rotation and removal of the pin 26. After removal of the pin 26, and separation of the structures 22 and 24, bushing 28 may be removed from structure 24 by forcing the bushing inward with a punch and hammer.

The present invention and many of its attendant advantages will be understood from the foregoing description and it will be apparent that various changes may be made in the form, construction, and arrangement of the parts thereof without departing from the spirit and scope of the invention or sacrificing its material advantages, the apparatus hereinbefore described being a preferred and exemplary embodiment.

What is claimed is:

1. A locator pin retention device, comprising:

a pin having a shaft with an axis, said shaft adapted to couple a first gas turbine engine structure to a second gas turbine engine structure for fixing the location of the second structure in a plane transverse to the shaft axis, while allowing movement of the second structure in the direction of the shaft axis;

pin retention means adapted for insertion into a bore through the first gas turbine engine structure; and said pin retention means having a first portion adapted to retain said pin in engagement with said first and second gas turbine engine structures, and a second portion spaced from said first portion by a stress relief groove, said second portion adapted to transfer loads between said structures in said transverse plane in shear to said engine structure.

2. The locator pin retention device of claim 1, further comprising:

said pin shaft having a first portion adapted to lockingly engage with said first portion of said pin retention means, and a second portion adapted to engage said pin retention means second portion and said second gas turbine engine structure; and said retention means comprises a bushing.

3. The locator pin retention device of claim 2, wherein said bushing first portion has a threaded interior surface and said pin shaft first portion has complimentary threads.

4. The locator pin retention device of claim 3 wherein said bushing further comprises a lip for engaging a first surface of said first gas turbine engine structure, said lip having an anti-rotation flat adapted to lockingly engage a second surface of said first structure.

5. The locator pin retention device of claim 4, wherein said first surface faces said second gas turbine engine structure.

6. The locator pin retention device of claim 5, further comprising a tab washer; and said pin having a head with a flat;

wherein said tab washer engages said first gas turbine engine structure and said head for preventing rotation of said pin.

7. For an axial flow gas turbine engine having an axis, a radially inner engine ring member and a radially outer engine structure member, a locator pin retention system for fixedly retaining a locator pin in the radially outer engine structure, while the pin is floatingly located in the raidaly inner ring member to allow for differential thermal growth between the outer engine structure and the inner ring member and to prevent circumferential and axial movement of the inner ring member relative to the outer structure member, comprising:

a first smooth bore in the outer gas turbine engine structure, said bore having a first radius and a bore axis transverse to the engine axis;

a second smooth bore in the inner ring member, said second bore having a second radius smaller than said first radius and a bore axis transverse to the engine axis and substantially aligned with said first bore axis;

a bushing member for insertion within said first bore, said bushing having an inner surface, a smooth outer cylindrical surface and a lip extending circumferentially outward from a first end;

said outer cylindrical surface having a third radius greater than said first radius for establishing an interference fit with said first bore when said bushing is inserted within said outer gas turbine engine structure and said lip being operable to prevent over insertion;

said lip having a flat for fixedly engaging the outer gas turbine engine structure to prevent rotation of said bushing;

said bushing inner surface having a smooth cylindrical first portion and a threaded second portion, said first portion extending from said first end and having a fourth radius, and said second threaded portion being spaced from said bushing first portion by a groove and said bushing first portion having a minor thread radius greater than said fourth radius;

a pin member having a head and a shaft for coupling together said outer engine structure, said bushing, and said inner ring member;

said shaft having a smooth cylindrical first portion for engaging said bushing first portion and in close tolerance fit and said second bore in axial sliding engagement, and said shaft having a threaded second portion substantially adjacent said head for lockingly engaging said bushing threaded second portion;

whereby said locator pin retention system allows differential thermal growth between said outer engine structure and said inner ring member radially with respect to the engine axis and along said shaft axis while retaining the inner ring member axially and circumferentially fixed with respect to the engine axis thereby reacting axial and circumferential loads applied to the inner ring member in shear through the bushing first portion to the outer engine structure.

8. A locator pin retention device for retaining a locator pin within a bore through a radially outer gas turbine engine structure and a bore in an inner ring member to circumferentially and axially locate the inner ring member with respect to the outer structure while allowing for differential radial thermal growth therebetween, comprising:

a pin member having a head for coupling with an outer surface of the outer engine structure, a shaft adapted for insertion through a bore in the outer engine structure and a nose portion adapted to be received by a bore in the inner ring member;

said pin shaft having a threaded first portion and a smooth cylindrical second portion;

a bushing member having a smooth outer cylindrical surface adapted to provide an interference fit when inserted within the bore in the outer gas turbine engine structure, and a lip for engaging an inner surface of the outer gas turbine engine structure, said lip having a flat for fixedly engaging the outer gas turbine engine structure to prevent rotation of said bushing;

said bushing member having a smooth cylindrical first portion for engaging said pin shaft second portion in a close tolerance fit and a second threaded portion spaced by a groove from said bushing first portion, said second threaded portion being adapted to receive said pin shaft threads; and means to prevent said pin member from loosening during engine operation;

whereby the pin shaft second portion allows for radial expansion of the inner ring member relative to the outer structure and engagement between said pin and bushing reacts axial and circumferential loads applied to the inner member in shear through the bushing first portion to the outer engine structure while retaining the inner ring member substantially axially and circumferentially fixed.

9. An axial gas flow turbine engine having a plurality of the locator pin retention devices of claim 8 retaining an inner ring member in a substantially fixed axial and circumferential relationship to an outer engine structure.

* * * * *